US008051794B2

(12) United States Patent
Matsueda et al.

(10) Patent No.: US 8,051,794 B2
(45) Date of Patent: Nov. 8, 2011

(54) ROWING BOAT FOOTREST ASSEMBLY

(75) Inventors: Keiji Matsueda, Osaka (JP); Yasushi Nakamura, Osaka (JP)

(73) Assignee: Shimano Inc., Osaka (JP)

( * ) Notice: Subject to any disclaimer, the term of this patent is extended or adjusted under 35 U.S.C. 154(b) by 438 days.

(21) Appl. No.: 12/059,487

(22) Filed: Mar. 31, 2008

(65) Prior Publication Data

US 2009/0241827 A1 Oct. 1, 2009

(51) Int. Cl.
*B63B 17/00* (2006.01)

(52) U.S. Cl. ..... 114/363

(58) Field of Classification Search ..... 114/363
See application file for complete search history.

(56) References Cited

U.S. PATENT DOCUMENTS

| | | | | |
|---|---|---|---|---|
| 2,280,437 | A | 4/1942 | Levesque | |
| 2,609,430 | A | 9/1952 | Bower | |
| 2,947,921 | A | 8/1960 | Watelet | |
| 2,972,485 | A | 2/1961 | Ferchland | |
| 5,367,976 | A * | 11/1994 | Van Schaik | 114/347 |
| 2006/0183385 | A1 | 8/2006 | Kaufer | |
| 2006/0292940 | A1 | 12/2006 | Ewans | |
| 2008/0229875 | A1 * | 9/2008 | Ray | 74/594.6 |

FOREIGN PATENT DOCUMENTS

| | | | |
|---|---|---|---|
| AT | 387 522 | B | 2/1989 |
| DE | 1 945 718 | | 3/1971 |
| DE | 9309887 | U | 8/1993 |
| DE | 4324864 | A1 | 1/1995 |
| DE | 196 23 825 | C1 | 1/1998 |
| DE | 10 2004 050 664 | B3 | 3/2006 |
| WO | WO 2006/042622 | A1 * | 4/2006 |

OTHER PUBLICATIONS

German Search Report of corresponding German Application No. 10 2009 007 165.2 dated Dec. 3, 2009.

* cited by examiner

*Primary Examiner* — Stephen Avila
(74) *Attorney, Agent, or Firm* — Global IP Counselors, LLP

(57) ABSTRACT

A rowing boat footrest assembly includes a footrest member coupled to a boat structure and a shoe retaining mechanism supported to the footrest member. The shoe retaining mechanism includes a permanent magnet mechanism operable between a shoe retaining mode and a shoe releasing mode.

15 Claims, 11 Drawing Sheets

ROWING BOAT FOOTREST ASSEMBLY

BACKGROUND OF THE INVENTION

1. Field of the Invention

This invention generally relates to a rowing boat footrest assembly. More specifically, the present invention relates to rowing boat footrest assembly that includes a pivotable footrest member.

2. Background Information

Rowing is becoming an increasingly more popular form of recreation. Moreover, rowing has become a very popular competitive sport for both amateurs and professionals. Whether rowing is for recreation or competition, the rowing industry is constantly improving the various components of rowing boats and equipment used by rowing enthusiasts. One component that has been extensively redesigned is the rowing boat footrest structure.

Traditionally, the footrest in a rowboat is an angled surface upon which a rower can brace his or her feet to provide increased power during the rowing process. Recently, footrests have been provided with simple shoe retaining straps or mechanisms that hold a rower's shoe against the surface of the footrest. However, there is a problem with such structures in that the rowers shoe and foot are fixed in place and cannot move or pivot with the motion of the rower during the rowing back and forth stroke.

In view of the above, it will be apparent to those skilled in the art from this disclosure that there exists a need for an improved footrest configuration that allows for movement of a rower's foot relative to a footrest. This invention addresses this need in the art as well as other needs, which will become apparent to those skilled in the art from this disclosure.

SUMMARY OF THE INVENTION

One object of the present invention is to provide a rowboat footrest with a pivoting footrest structure that supports a rower's shoes.

Another object of the present invention is to provide a rowboat footrest with a pivoting footrest structure that includes a simple shoe retaining and releasing mechanism.

The foregoing objects can basically be attained by providing a rowing boat footrest assembly with a footrest member coupled to a boat structure and a shoe retaining mechanism supported to the footrest member. The shoe retaining mechanism includes a permanent magnet mechanism operable between a shoe retaining mode and a shoe releasing mode.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
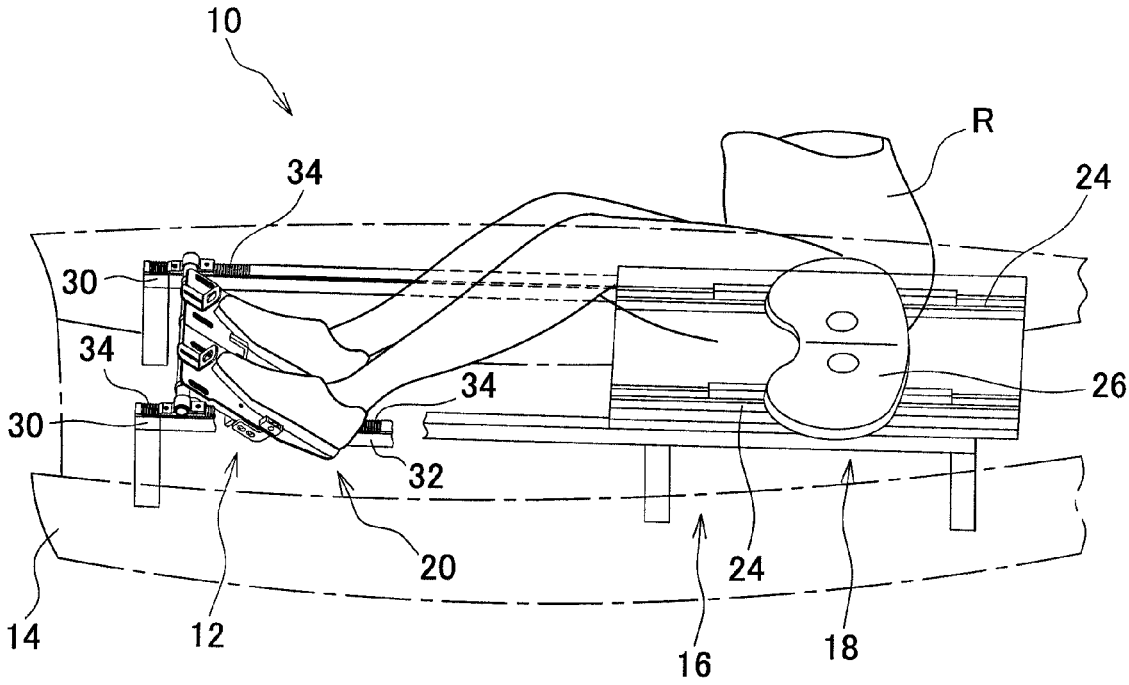
FIG. 1 is a side perspective view of a boat hull that includes a footrest assembly in accordance with one embodiment of the present invention.

Referring initially to FIG. 1, a rowboat 10 that includes a rowing boat footrest assembly 12 is illustrated in accordance with a first embodiment of the present invention.

The rowboat 10 includes a boat hull 14 and a support structure 16. The support structure 16 includes a seat support portion 18 and a footrest assembly support portion 20.

The seat support portion 18 includes rails 24 upon which a seat 26 can glide back and forth with the movement of a rower R. The footrest assembly support portion 20 includes parallel rails 30 and a base rail 32 that are provided with gear teeth 34.

Figure 2:
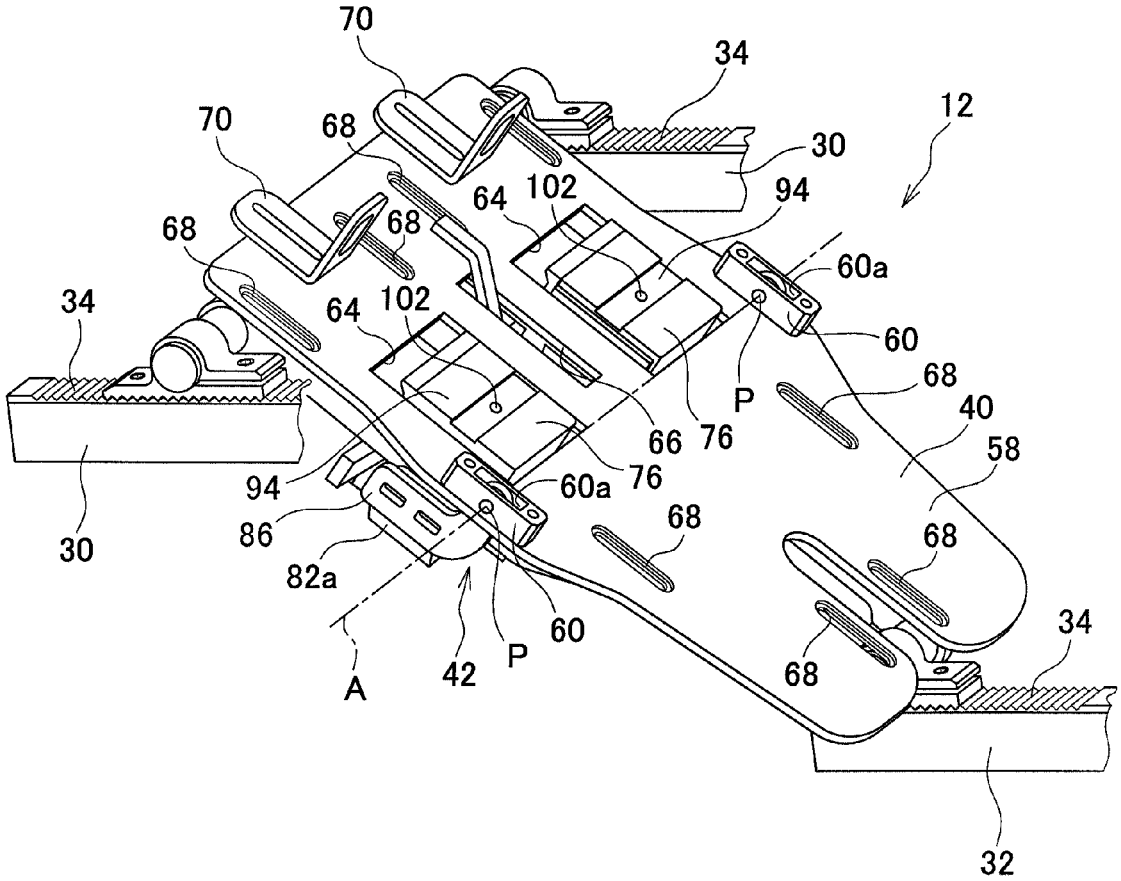
FIG. 2 is a perspective view of the footrest assembly removed from the boat hull showing a footrest member and a shoe retaining mechanism in accordance with one embodiment of the present invention.
Figure 3:
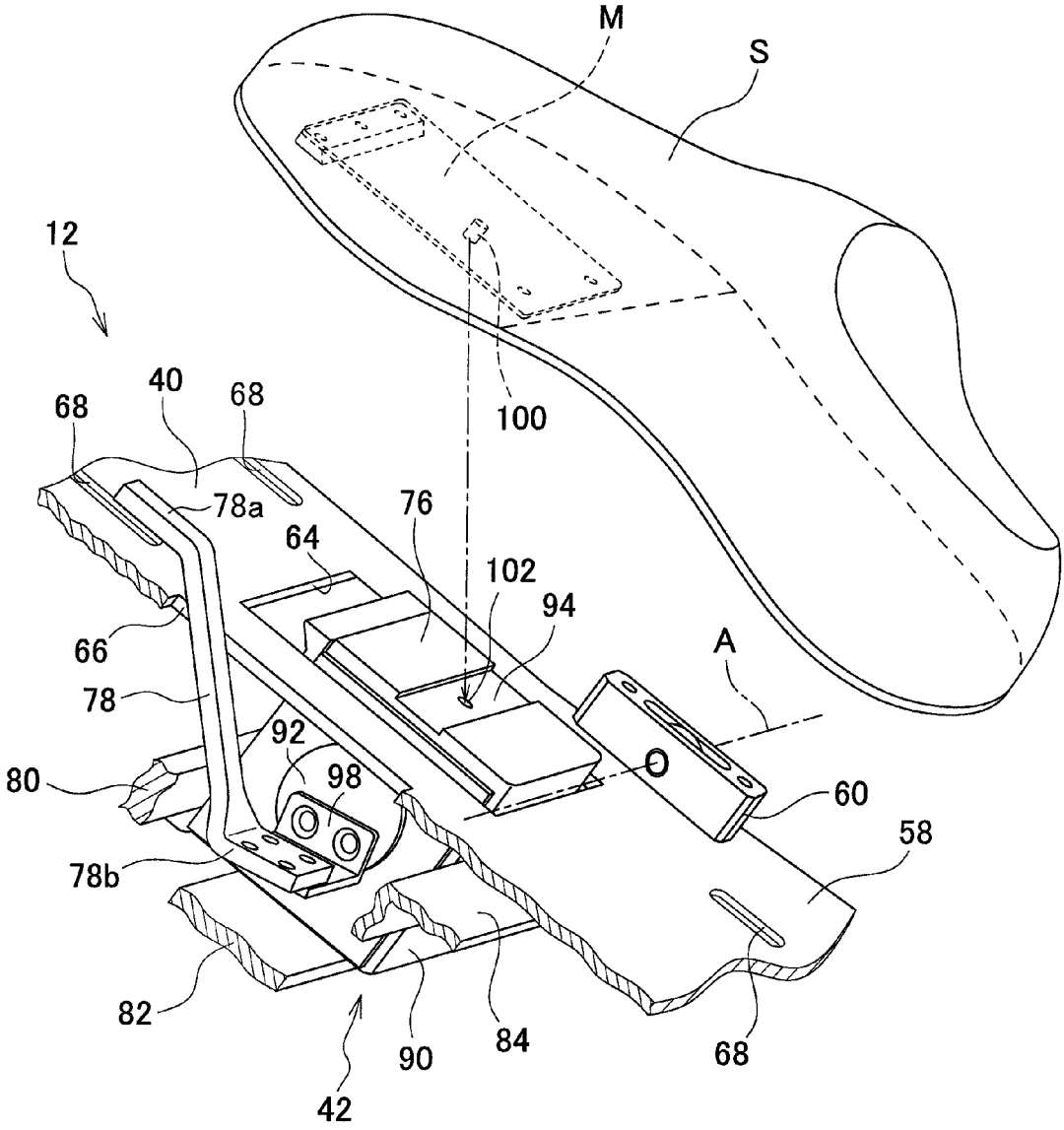
FIG. 3 is an exploded perspective view of a portion of the footrest assembly showing an operating lever of the shoe retaining mechanism and a rower's shoe in accordance with one embodiment of the present invention.
Figure 11:
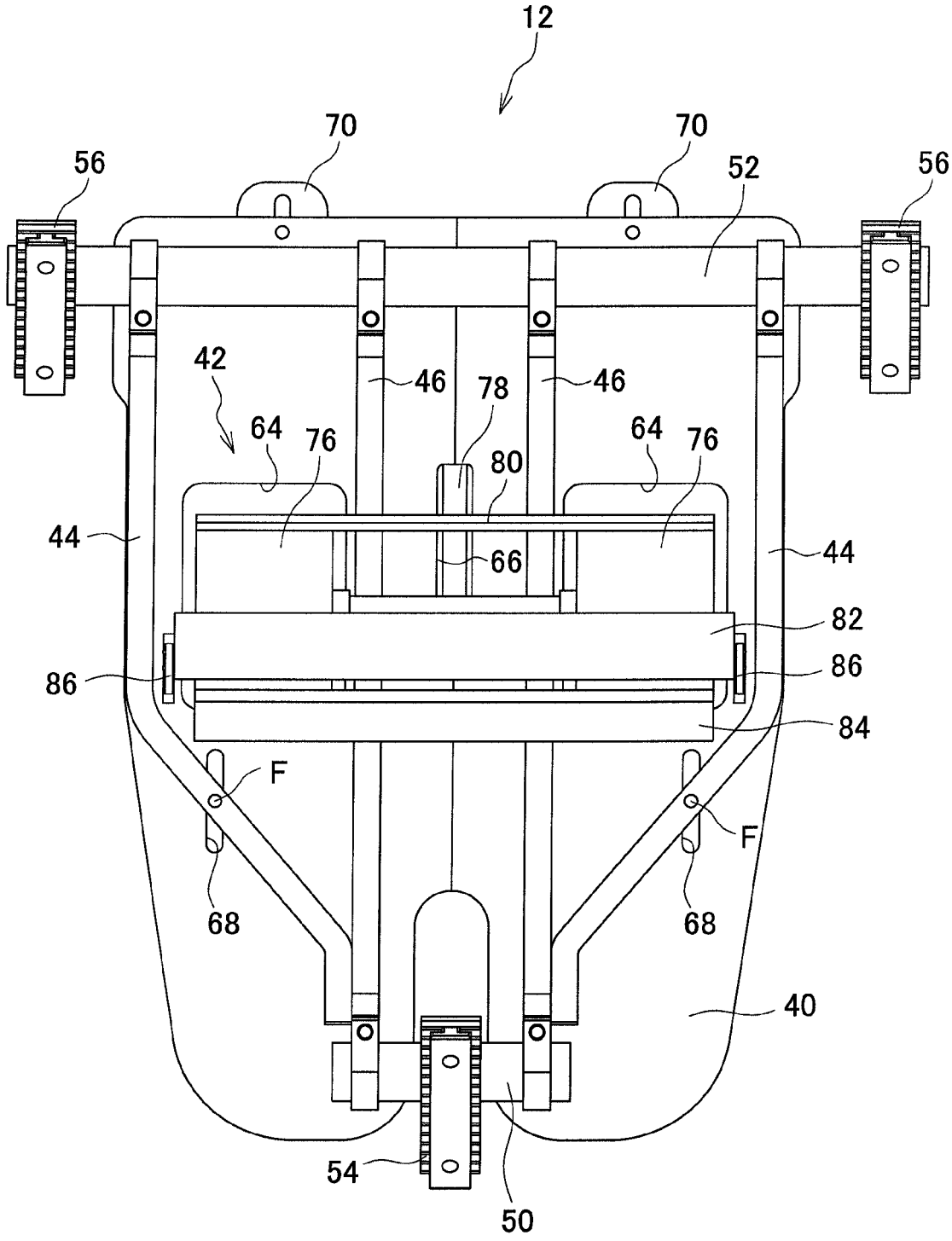
FIG. 11 is a bottom view of the footrest assembly showing support elements of the footrest assembly in accordance with one embodiment of the present invention.

A description of the footrest assembly 12 is now provided with initial reference to FIGS. 2, 3 and 11. The footrest assembly 12 basically includes a footrest member 40 that is supported within the boat hull 14 (a boat structure) and a shoe retaining mechanism 42 that is supported to the footrest member 40 in a manner described in greater detail below.

As best shown in FIG. 11, the footrest member 40 is a generally flat plate-like member that is supported by the following members: support elements 44, support elements 46, a lower support rod 50, an upper support rod 52, lower block assembly 54 and upper block assemblies 56.

As best shown in FIGS. 2 and 3, the footrest member 40 includes a footrest surface 58, pivot support portions 60, a pair of openings 64, a central opening 66, a plurality of slots 68 and a pair of adjustable shoe stops 70.

Figure 7:
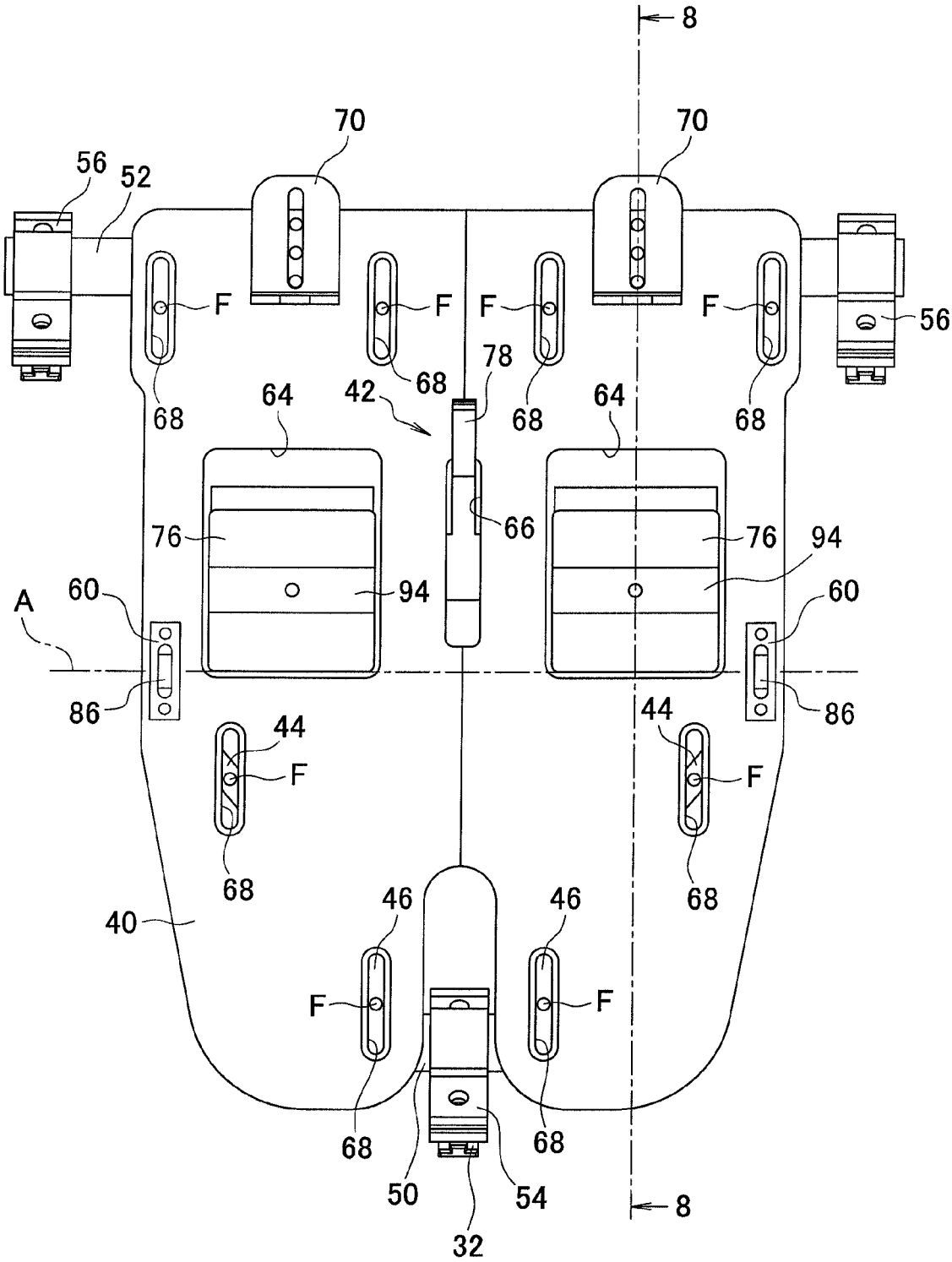
FIG. 7 is a top view of the footrest assembly showing a shoe contacting portion of the shoe retaining mechanism in accordance with one embodiment of the present invention.

With reference again to FIG. 11, the support elements 44 and the support elements 46 extend along an underside of the footrest member 40. Fasteners F extending through the slots 68 fix the footrest member 40 to the support elements 44 and the support elements 46, as shown in FIG. 7. The support elements 46 extend between the lower support rod 50 and the upper support rod 52. Further, a lower end of each of the support elements 46 is clamped to the lower support rod 50 and an upper end of each of the support elements 46 is clamped to the upper support rod 52.

The lower block assembly 54 is fixed to the lower support rod 50 and the upper block assemblies 56 are fixed to respective ends of the upper support rod 52. The lower block assembly 54 and the upper block assemblies 56 are provided with gear teeth corresponding to gear teeth 34. Consequently, the longitudinal positioning of the footrest member 40 can be adjusted relative to the parallel rails 30 and the base rail 32. Specifically, the lower block assembly 54 and the upper block assemblies 56 can be lifted off the parallel rails 30 and the base rail 32 allowing re-positioning of the footrest member 40 relative to the hull 14 of the rowboat 10. The interaction between the gear teeth 34 of the parallel rails 30 and the base rail 32 and the lower block assembly 54 and the upper block assemblies 56 maintain the footrest assembly 12 in a fixed position when the rower R is rowing.

As best indicated in FIG. 7, the slots 68 in the footrest member 40 are oblong or elongated. Consequently, if the fasteners F extending through the slots 68 are loosened, the position of the footrest member 40 relative to the support elements 44 and the support elements 46 can be adjusted. Thus, the vertical position of the footrest member 40 can be adjusted relative to the support structure 16 and the boat hull 14.

A description of the shoe retaining mechanism 42 is now provided with specific reference to FIGS. 3-11. The shoe retaining mechanism 42 includes a pair of permanent magnet mechanisms 76 that are operable between a shoe retaining mode and a shoe releasing mode. More specifically, the shoe retaining mechanism 42 includes a lever 78 (an actuation portion) that is operably connected to both of the permanent magnet mechanisms 76 (shoe retaining portions). In FIGS. 3-8 and 10, the lever 78 is positioned such that the permanent magnet mechanisms 76 are in the shoe retaining mode and in FIG. 9 the lever 78 is positioned such that the permanent magnet mechanisms 76 are in the shoe releasing mode. A more detailed description of the permanent magnet mechanisms 76 is provided below.

Figure 4:
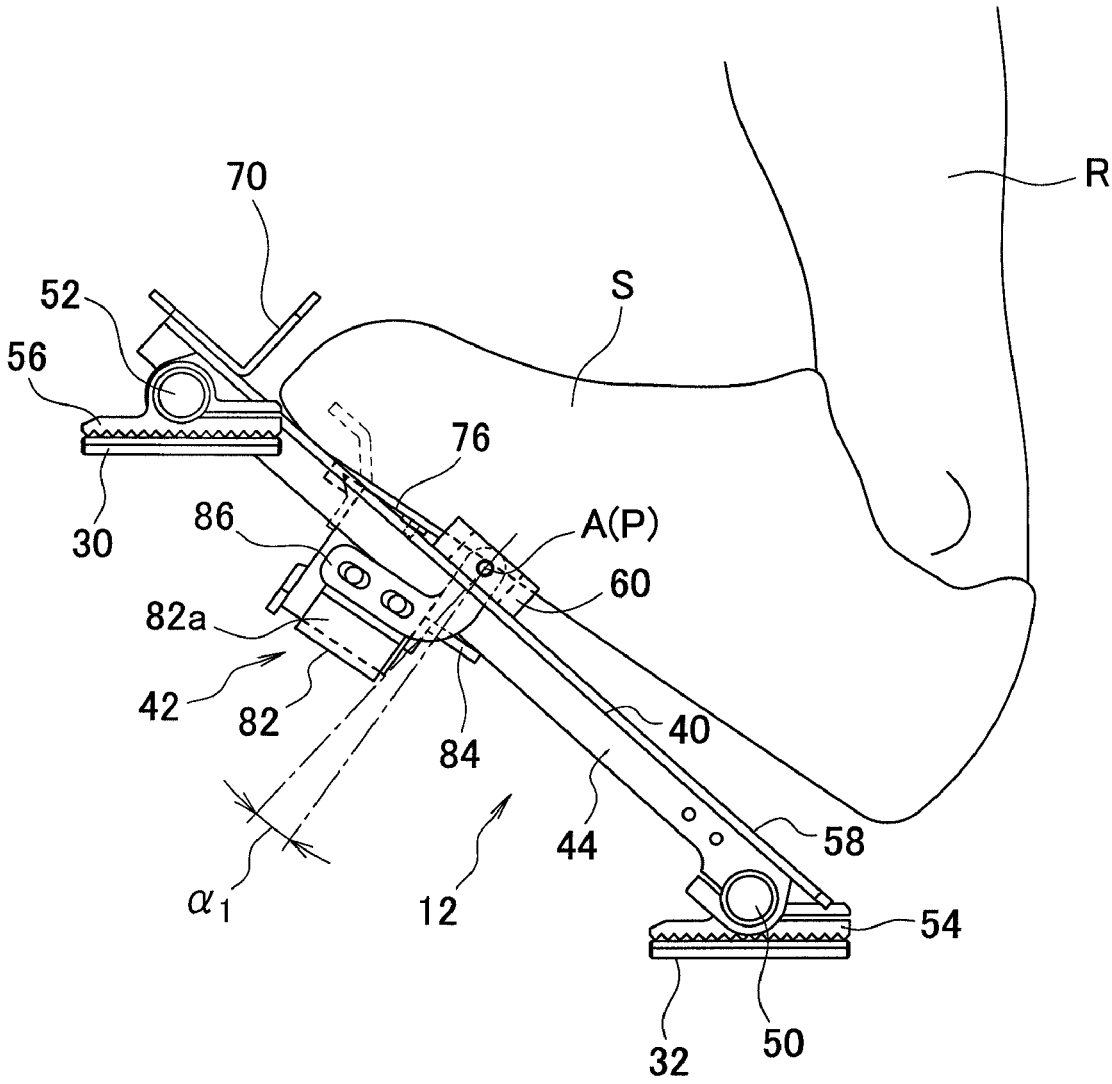
FIG. 4 is a side elevational view of the footrest assembly showing a pivot support structure of the shoe retaining mechanism with the rower's shoe pivoted to an upward position in accordance with one embodiment of the present invention.
Figure 5:
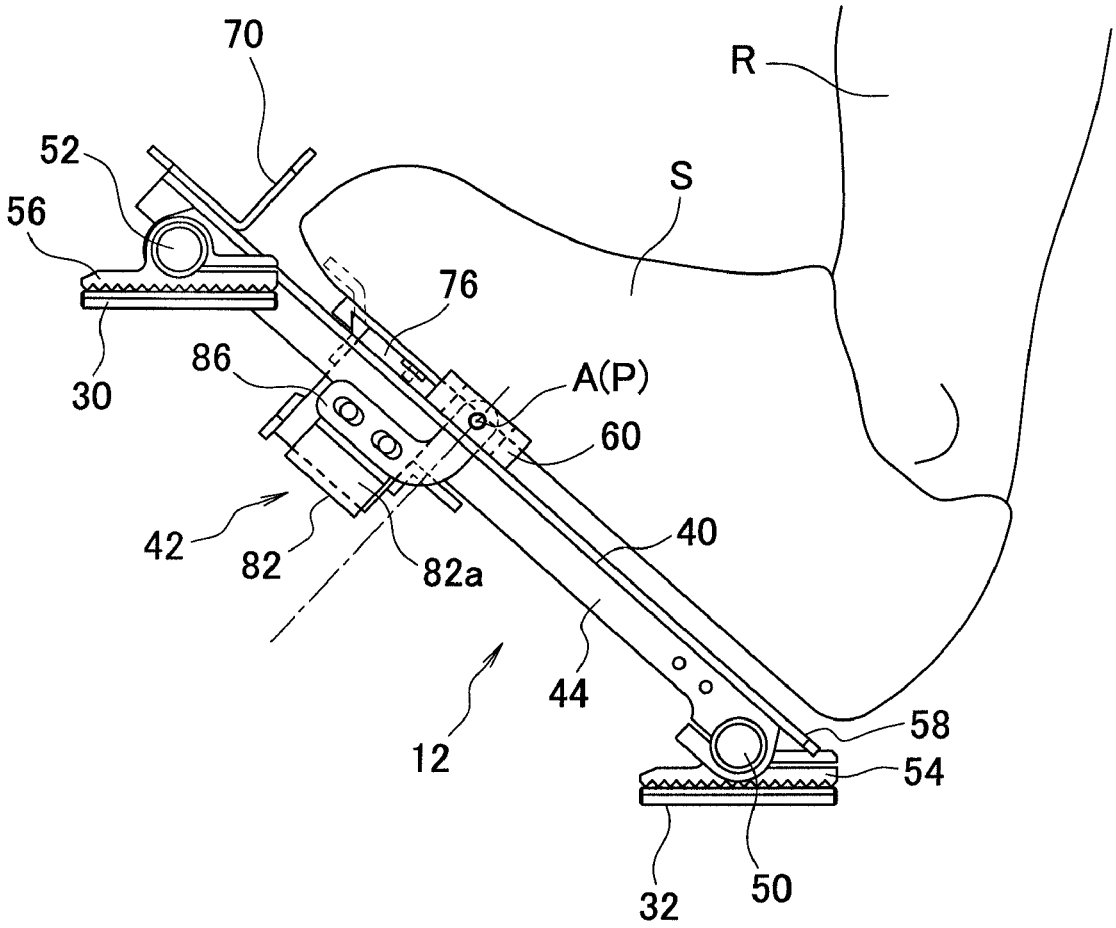
FIG. 5 is another side elevational view of the footrest assembly similar to FIG. 4 showing the pivot support structure of the shoe retaining mechanism with the rower's shoe pivoted to an intermediate position in accordance with one embodiment of the present invention.
Figure 6:
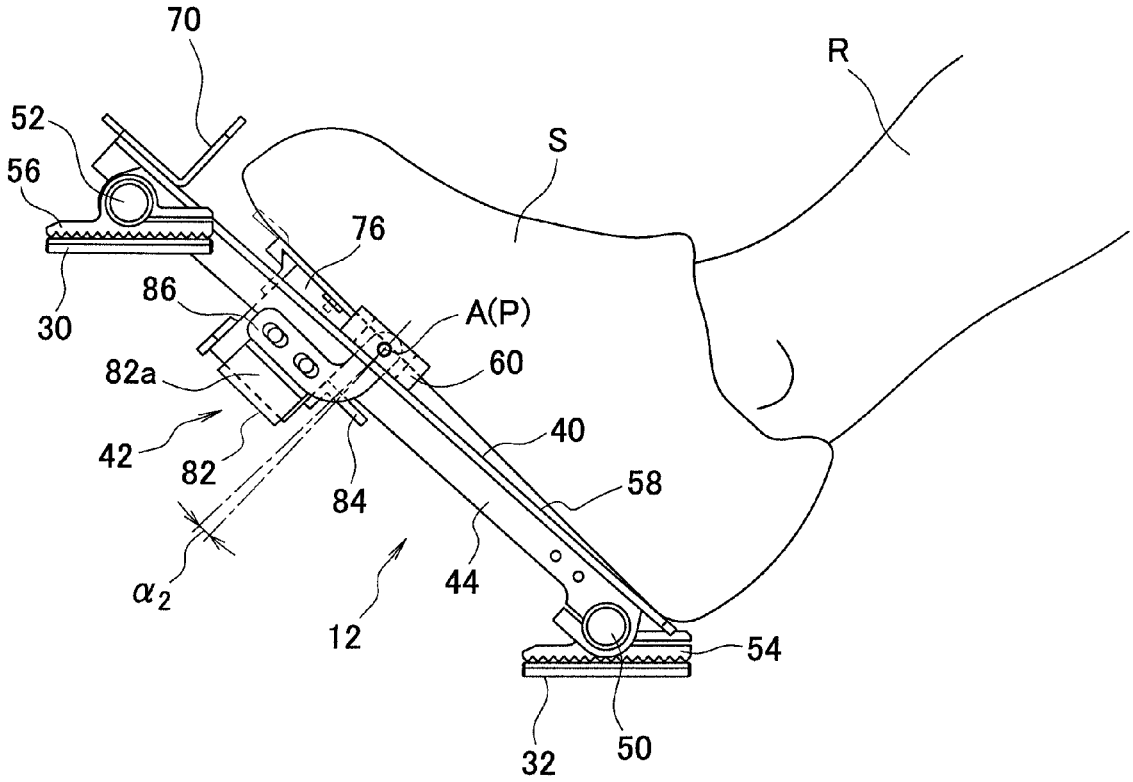
FIG. 6 is another side elevational view of the footrest assembly similar to FIGS. 4 and 5 showing the pivot support structure of the shoe retaining mechanism with the rower's shoe pivoted to a downward position in accordance with one embodiment of the present invention.
Figure 8:
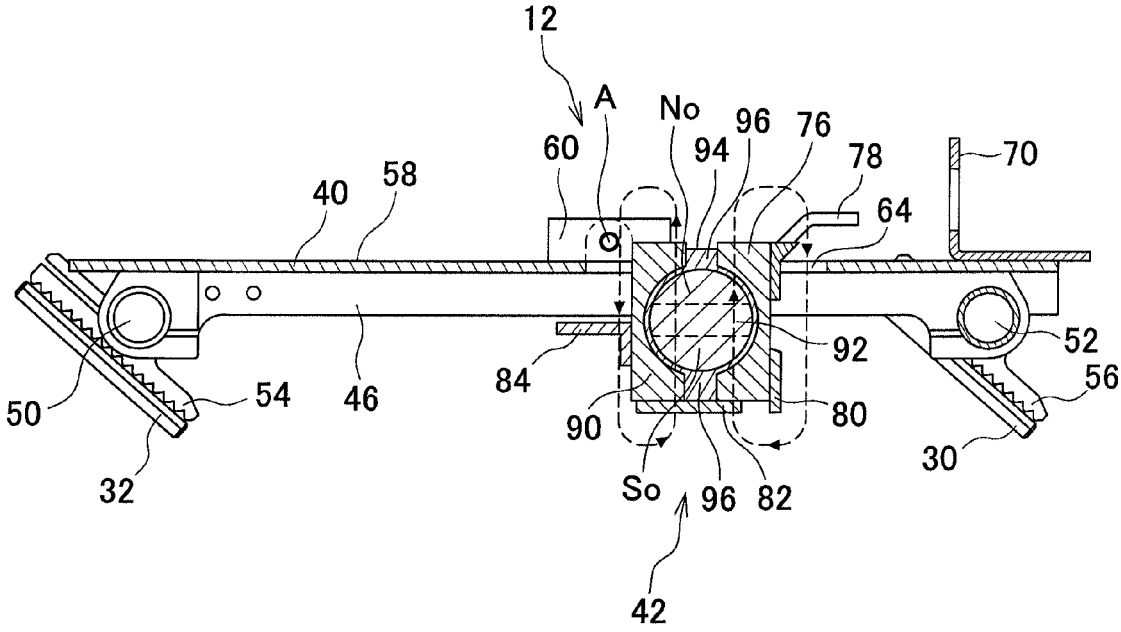
FIG. 8 is a side cross-sectional view of the footrest assembly showing a magnet structure of the shoe retaining mechanism in a shoe retaining position in accordance with one embodiment of the present invention.
Figure 9:
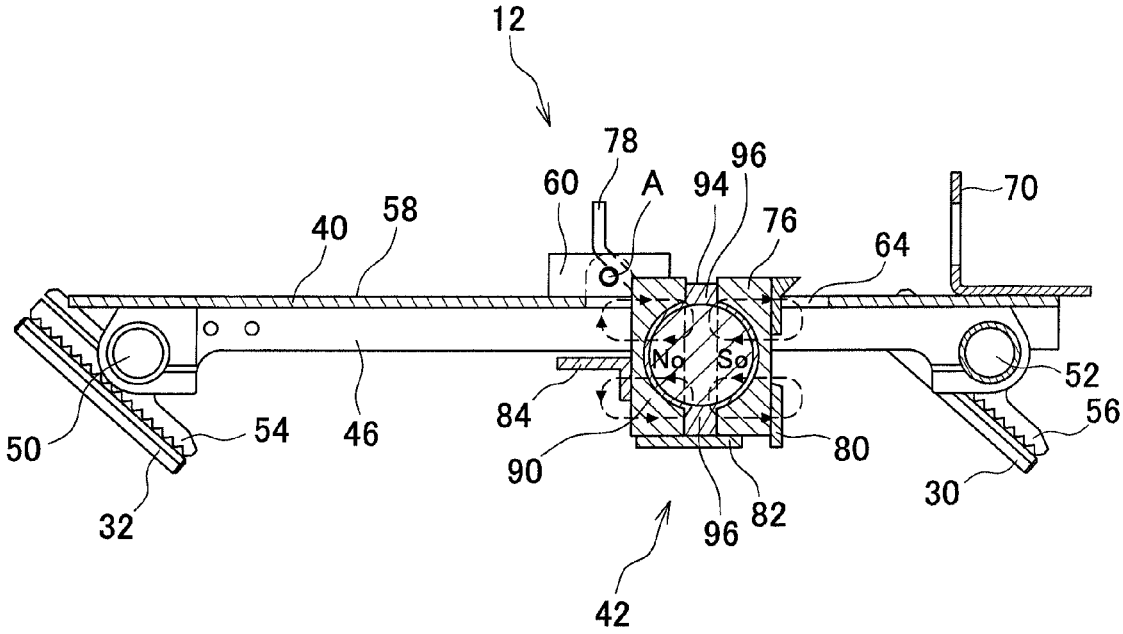
FIG. 9 is a side cross-sectional view of the footrest assembly showing the magnet structure of the shoe retaining mechanism in a shoe releasing position in accordance with one embodiment of the present invention.
Figure 10:
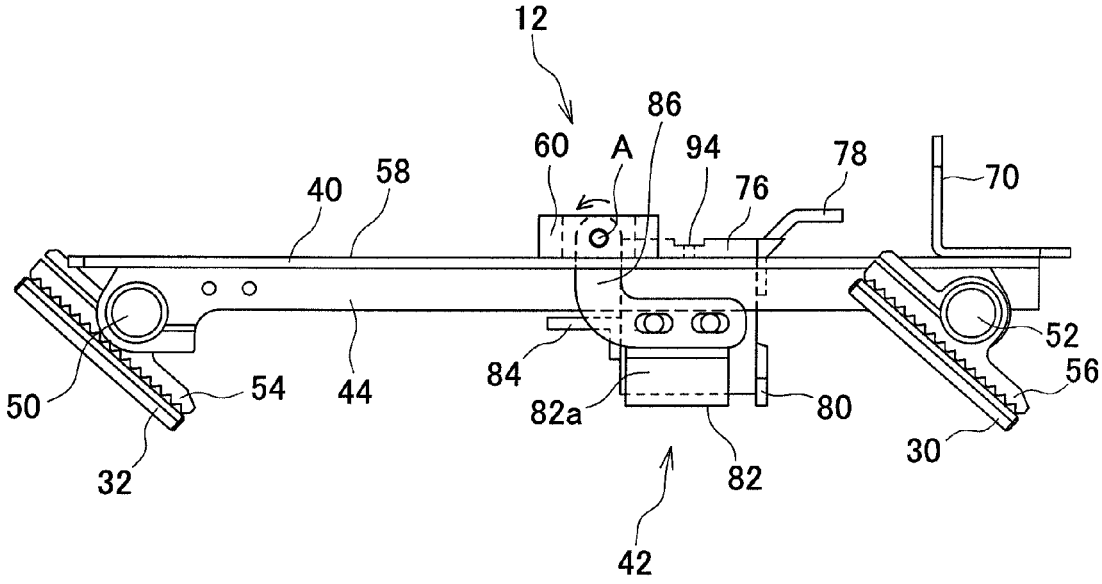
FIG. 10 is another side elevational view of the footrest assembly showing details of the pivot support structure of the shoe retaining mechanism in accordance with one embodiment of the present invention.

As best shown in FIGS. 3 and 8-11, the shoe retaining mechanism 42 further includes an upper support member 80, a central support member 82, a lower support member 84 and pivot brackets 86 (FIGS. 10 and 11). The upper support member 80 is fixed to upper outer surfaces of the permanent magnet mechanisms 76 thereby fixing the permanent magnet mechanisms 76 to one another. The upper support member 80 is a flat bar shaped member that is preferably made of metal to provide rigidity between the permanent magnet mechanisms 76. The central support member 82 is a U-shaped metallic member that is fixed to respective undersides of the permanent magnet mechanisms 76. Lateral portions 82*a* of the central support member 82 extend along opposite sides of the permanent magnet mechanisms 76, as indicated in FIGS. 4, 5 and 6. The lower support member 84 is fixed to respective lower surfaces of the permanent magnet mechanisms 76. The lower support member 84 preferably has an L-shape and provides a stop for pivoting movement of the shoe retaining mechanism 42 and the permanent magnet mechanisms 76, as described further below.

The upper support member 80, the central support member 82, the lower support member 84 and the permanent magnet mechanisms 76 are assembled as a single rigid structure that is configured to pivot about a pivot axis A, shown in FIGS. 2-10. As shown in FIGS. 2-10, the shoe retaining mechanism 42 is pivotally supported to the footrest member 40 about the pivot axis A with the pivot axis A extending parallel to and above the footrest surface 58.

As best shown in FIGS. 2 and 4-6 and 10, the pivot brackets 86 are fixed to the lateral portions 82*a* of the central support member 82. The pivot brackets 86 extend upward into slots 60*a* (FIG. 2) formed in the pivot portions 60 of the footrest member 40. As shown in FIG. 2, pivot pins P are supported in the pivot portions 60 and pivotally retain the pivot brackets 86 relative to pivot portions 60. The pivot pins P are aligned with and define the pivot axis A.

As best shown in FIGS. 4, 5 and 6, the shoe retaining mechanism 42 pivots as a unit about the pivot axis A. In FIG. 4, the shoe S of the rower R is shown pivoted to an upward position. In FIG. 5, the shoe S of the rower R is shown pivoted to an intermediate position. In FIG. 6, the shoe S of the rower R is shown pivoted to a downward position. In FIG. 4, an angle $\alpha_1$ is shown measured relative to the intermediate position depicted in FIG. 5. The angle $\alpha_1$ can be anywhere from 5 to 10 degrees. In FIG. 6, an angle $\alpha_2$ is shown measured relative to the intermediate position depicted in FIG. 5. The angle $\alpha_2$ can be anywhere from 5 to 10 degrees. The total angular displacement of the shoe S about the pivot axis A is preferably 20 degrees or less relative to the footrest member 40. In other words, the total angular displacement, which includes angle $\alpha_1$ plus angle $\alpha_2$ is preferably 20 degrees.

The overall angular displacement of the shoe S can be adjusted by changing the position of the lower support member 84 of the shoe retaining mechanism 42. Specifically, the lower support member 84 contacts the underside of the footrest member 40, as shown in FIG. 4. Thus, the lower support member 84 limits angular displacement of the shoe retaining mechanism 42 relative to the footrest member 40. The shoe S limits angular displacement of the shoe retaining mechanism 42 when the heel of the shoe S contacts the footrest surface 58 of the footrest member 40, as shown in FIG. 6.

A description of the permanent magnet mechanisms 76 and the lever 78 is now provided with specific reference to FIGS. 8 and 9. The permanent magnet mechanisms 76 are identical to one another. Therefore, only one of the permanent magnet mechanisms 76 is described for the sake of brevity, since description of one applies to both.

The permanent magnet mechanism 76 includes an outer casing 90 and a permanent magnet 92. The outer casing 90 includes a shoe contact surface 94 and non-magnetizable elements 96. The non-magnetizable elements 96 can be made of aluminum or plastic materials. The permanent magnet 92 includes a north pole section No and a south pole section So. The upper support member 80, the central support member 82 and the lower support member 84 are fixed to outer surfaces of the outer casing 90, as described above.

The permanent magnet mechanism 76 is positioned such that a portion of the outer casing 90 that includes the shoe contact surface 94 extends through the opening 64 (an aperture) to the footrest surface 58 (an upper side) of the footrest member 40 and the remainder of the permanent magnet mechanism 76 is disposed beneath the footrest member 40 adjacent to the underside (the lower side) of the footrest member 40.

As best shown in FIG. 3, the lever 78 includes an operating portion 78*a* and an actuation portion 78*b*. The operation portion 78*a* is disposed above the footrest surface 58 (the upper side) of the footrest member 40 and the actuation portion 78*b* is disposed adjacent to the underside (the lower side) of the footrest member 40. The actuation portion 78*b* of the lever 78 includes a pair of attachment brackets 98 (only one bracket 98 is shown in FIG. 3). The attachment brackets 98 are fixed to respective ones of the permanent magnets 92 and to the actuation portion 78*b* of the lever 78, as indicated in FIG. 3. Therefore, the lever 78 is rigidly fixed to the permanent magnets 92 of the permanent magnet mechanisms 76. Hence, movement of the lever 78 causes the permanent magnets 92 of the permanent magnet mechanisms 76 to rotate or pivot relative to the outer casing 90 of the permanent magnet mechanisms 76. For example, in FIG. 8 the permanent magnets 92 of the permanent magnet mechanisms 76 are positioned in the shoe retaining mode. However, in FIG. 9, the lever 78 is pulled upward and to the left relative to FIG. 9 and the permanent magnets 92 of the permanent magnet mechanisms 76 are moved to the shoe releasing mode.

The permanent magnet mechanism 76 of the shoe retaining mechanism 42 operates as follows. The shoes S include a metallic or magnetically susceptible material M, as shown in FIG. 3. When the magnetically susceptible material M is placed near a magnet, the magnetically susceptible material M is drawn and held to the magnet. As indicated in FIG. 8, when the permanent magnet 92 is oriented with the north pole section No and the south pole section So aligned with the outer casing 90, a magnetic field is present at and above the shoe contact surface 94 and the shoe S and magnetically susceptible material M can be held in place. The permanent magnet 92 and the permanent magnet mechanisms 76 are configured such that between 15 and 20 Kg of force are applied to the magnetically susceptible material M of each of the shoes S when the shoes are placed in contact with the shoe contact surface 94. This force is sufficient to secure the shoes S of a rower R when rowing.

As indicated in FIG. 9, when the lever 78 is manually rotated to the shoe releasing mode, the north pole section No and the south pole section So are pivoted to an orientation that is perpendicular to the non-magnetizable elements 96. Thus, the non-magnetizable elements 96 can interfere with propagation of the magnetic fields, hence the magnetic fields are cancelled or reduced to a level such that the shoe S and magnetically susceptible material M can be easily removed from the shoe contact surface 94.

The shoes S and/or the magnetically susceptible material M can optionally include alignment pins 100, as shown in FIG. 3. The shoe contact surface 94 of the permanent magnet mechanism 76 includes apertures or openings 102 dimensioned to receive the alignment pins 100. The openings 102 and the alignment pins 100 provide a simple means for properly positioning the shoes S on the shoe contact surface 94 of the permanent magnet mechanism 76 prior to moving the lever 78 and permanent magnets 92 of the permanent magnet mechanisms 76 of the shoe retaining mechanism 42 to the shoe retaining mode.

It should be understood from the description and drawings herein that the non-magnetizable elements 96 are not magnets but are made of a material that can interfere with propagation of magnetic fields. However, the outer casing 90 is made of a material that promotes propagation of magnetic fields. With the permanent magnet 92 in the orientation shown in FIG. 8, imaginary lines of force of the magnetic field are parallel to the non-magnetizable elements 96 and can extend to the shoe contact surface 94. When the permanent magnets 92 are pivoted to the orientation depicted in FIG. 9, the lines of force of the magnetic field are not parallel to the non-magnetizable elements 96, and little or no magnetic field effects are present at the shoe contact surface 94.

With the above described embodiment of the present invention, a simple mechanical means for securing the shoes S of a rower R is made possible. Further with the shoes S secured to the permanent magnet mechanism 76 of the shoe retaining mechanism 42, the shoes S of the rower R can pivot about the pivot axis A. The pivoting movement of the shoes S and the shoe retaining mechanism 42 relative to the footrest surface 58 of the footrest assembly 12 provides the rower R with improved freedom of movement while rowing.

GENERAL INTERPRETATION OF TERMS

In understanding the scope of the present invention, the term "configured" as used herein to describe a component, section or part of a device includes hardware that is constructed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the present invention, the following directional terms "forward, rearward, above, downward, vertical, horizontal, below and transverse" as well as any other similar directional terms refer to those directions of a boat equipped with the present invention. Accordingly, these terms, as utilized to describe the present invention should be interpreted relative to a boat equipped with the present invention as used in the normal riding position. Finally, terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A rowing boat footrest assembly comprising:

a footrest member configured to be nonmovably coupled to a boat structure, the footrest member including a plate member having a fixed footrest surface with a first portion and a second portion; and a shoe retaining mechanism pivotally supported to the footrest member such that the shoe retaining mechanism selectively pivots relative to the fixed footrest surface about a pivot axis that extends parallel to and above the fixed footrest surface, the shoe retaining mechanism having a permanent magnet mechanism operable between a shoe retaining mode and a shoe releasing mode, the first and second portions of the fixed footrest surface being disposed on opposite ends of the shoe retaining mechanism with respect to a direction perpendicular to the pivot axis.

2. The rowing boat footrest assembly according to claim 1, wherein the shoe retaining mechanism is limited to angular displacement about the pivot axis of 20 degrees or less relative to the footrest member.

3. The rowing boat footrest assembly according to claim 1, wherein the shoe retaining mechanism includes an actuation portion and a shoe retaining portion, the actuation portion being movably arranged with respect to the footrest member to be manually moved between the shoe retaining mode and the shoe releasing mode.

4. A rowing boat footrest assembly comprising:

a footrest member configured to be nonmovably coupled to a boat structure, the footrest member including a fixed footrest surface which is a shoe-mountable surface; and a shoe retaining mechanism pivotally supported to the footrest member such that the shoe retaining mechanism selectively pivots relative to the fixed footrest surface about a pivot axis that extends parallel to and above the fixed footrest surface, the shoe retaining mechanism having a permanent magnet mechanism operable between a shoe retaining mode and a shoe releasing mode, the shoe retaining mechanism including an actuation portion and a shoe retaining portion, the actuation portion being movably arranged with respect to the footrest member to be manually moved between the shoe retaining mode and the shoe releasing mode, the footrest member including at least one aperture extending from a lower side of the footrest member to an upper side of the footrest member, and the actuation portion being disposed at the lower side of the footrest member and the shoe retaining portion extends through the aperture to the upper side of the footrest member.

5. The rowing boat footrest assembly according to claim 1, wherein the shoe retaining mechanism includes a permanent magnet pivotally arranged with respect to the footrest member between the shoe retaining mode and the shoe releasing mode.

6. A rowing boat footrest assembly comprising:

a footrest member configured to be coupled to a boat structure; and a shoe retaining mechanism supported to the footrest member having a permanent magnet mechanism operable between a shoe retaining mode and a shoe releasing mode, the shoe retaining mechanism including a permanent magnet pivotally arranged with respect to the footrest member between the shoe retaining mode and the shoe releasing mode and a lever coupled to the permanent magnet to manually pivot the permanent magnet between the shoe retaining mode and the shoe releasing mode.

7. The rowing boat footrest assembly according to claim 6, wherein the lever and the permanent magnet are rigidly attached to at least one attachment bracket at separate locations on the at least one attachment bracket.

8. The rowing boat footrest assembly according to claim 6, wherein the permanent magnet is arranged such that interference in magnetic fields of the permanent magnet occurs while the permanent magnet is in the shoe releasing mode.

9. The rowing boat footrest assembly according to claim 6, wherein the permanent magnet pivots an amount corresponding to an amount the lever is pivoted.

10. A rowing boat footrest assembly comprising:

a footrest member coupled to a boat structure; and a shoe retaining mechanism supported to the footrest member having a permanent magnet mechanism operable between a shoe retaining mode and a shoe releasing mode, the shoe retaining mechanism including an actuation portion and a shoe retaining portion, the actuation portion being manually operable between the shoe retaining mode and the shoe releasing mode, the footrest member including at least one aperture extending from a lower side of the footrest member to an upper side of the footrest member, the actuation portion being disposed below the lower side of the footrest member, and the shoe retaining portion protruding out of the aperture at both the lower and upper sides of the footrest member such that the shoe retaining portion is partially disposed above the upper side and partially disposed below the lower side.

11. The rowing boat footrest assembly according to claim 10, wherein the shoe retaining mechanism includes a permanent magnet pivotally arranged with respect to the footrest member between the shoe retaining mode and the shoe releasing mode.

12. The rowing boat footrest assembly according to claim 11, wherein the actuation portion is a lever coupled to the permanent magnet to manually pivot the permanent magnet between the shoe retaining mode and the shoe releasing mode.

13. The rowing boat footrest assembly according to claim 12, wherein the lever and the permanent magnet are rigidly attached to at least one attachment bracket at separate locations on the at least one attachment bracket.

14. The rowing boat footrest assembly according to claim 11, wherein the permanent magnet is arranged such that interference in magnetic fields of the permanent magnet occurs while the permanent magnet is in the shoe releasing mode.

15. The rowing boat footrest assembly according to claim 12, wherein the permanent magnet pivots an amount corresponding to an amount the lever is pivoted.

* * * * *